US008030856B2

(12) United States Patent
Konishi

(10) Patent No.: US 8,030,856 B2
(45) Date of Patent: Oct. 4, 2011

(54) DISCHARGE LAMP LIGHTING DEVICE

(75) Inventor: Hirofumi Konishi, Osaka (JP)

(73) Assignee: Tabuchi Electric Co., Ltd., Osaka (JP)

( * ) Notice: Subject to any disclaimer, the term of this patent is extended or adjusted under 35 U.S.C. 154(b) by 340 days.

(21) Appl. No.: 12/312,284

(22) PCT Filed: Nov. 5, 2007

(86) PCT No.: PCT/JP2007/071863

§ 371 (c)(1),
(2), (4) Date: May 4, 2009

(87) PCT Pub. No.: WO2008/059769

PCT Pub. Date: May 22, 2008

(65) Prior Publication Data

US 2010/0072908 A1 Mar. 25, 2010

(30) Foreign Application Priority Data

Nov. 13, 2006 (JP) ..... 2006-335103

(51) Int. Cl.
*H05B 41/36* (2006.01)

(52) U.S. Cl. ..... 315/291; 315/209 R; 315/224; 315/246; 315/248; 315/307

(58) Field of Classification Search ..... 315/209 R, 315/224, 226, 246, 248, 291, 307, 311
See application file for complete search history.

(56) References Cited

U.S. PATENT DOCUMENTS 5,192,897 A * 3/1993 Vossough et al. ..... 315/308
5,453,667 A * 9/1995 Matsuda et al. ..... 315/248
5,844,380 A 12/1998 Siepkes
5,932,976 A * 8/1999 Maheshwari et al. ..... 315/291
6,177,768 B1 1/2001 Kamata et al.
6,380,694 B1 * 4/2002 Uchihashi et al. ..... 315/244
(Continued)

FOREIGN PATENT DOCUMENTS

JP 04-023097 U 2/1992
(Continued)

OTHER PUBLICATIONS

International Search Report mailed on Jan. 29, 2008.

*Primary Examiner* — Douglas W Owens
*Assistant Examiner* — Thai Pham
(74) *Attorney, Agent, or Firm* — Rader, Fishman & Grauer PLLC

(57) ABSTRACT

A discharge lamp lighting device has an oscillation control circuit for determining a frequency with time constant of R and C, a L-C series resonant circuit connected to a half bridge or full bridge operating at the frequency and a circuit in which one end of hot cathodes at both ends of a hot cathode type discharge tube are respectively connected to both ends of a resonant capacitor. A capacitor is further connected in series to other ends of filaments at both ends of the discharge tube for lighting. Dimming of tube current is achieved by changing the oscillation frequency with a DC dimming control voltage by use of a variable capacitor or diode for determining the frequency of the oscillation control circuit. By simultaneously changing the tube current and a filament current of the discharge lamp, the tube current is decreased upon dimming and the filament current is increased.

8 Claims, 13 Drawing Sheets

U.S. PATENT DOCUMENTS

| | | | | |
|---|---|---|---|---|
| 6,870,327 | B2 * | 3/2005 | Takahashi et al. | 315/248 |
| 7,508,279 | B2 * | 3/2009 | Ikeda | 331/117 R |
| 2006/0238137 | A1 * | 10/2006 | Ohta | 315/209 R |

FOREIGN PATENT DOCUMENTS

| | | | |
|---|---|---|---|
| JP | 07-211478 | A | 8/1995 |
| JP | 09-213491 | A | 8/1997 |
| JP | 10-214696 | A | 8/1998 |
| JP | 10-294194 | A | 11/1998 |
| JP | 11-509963 | A | 8/1999 |
| JP | 2000-133478 | A | 5/2000 |
| JP | 2001-357994 | A | 12/2001 |
| JP | 2003-007484 | A | 1/2003 |
| WO | WO 97/43877 | A1 | 11/1997 |

* cited by examiner

FILAMENT CURRENT VARIABLE upon DIMMING, 2-POWER-SUPPLY CONFIGURATION

PRIOR ART

DISCHARGE LAMP LIGHTING DEVICE

TECHNICAL FIELD

The present invention relates to a hot cathode type discharge lamp lighting device capable of performing stable discharge operation and nonstep dimming control.

BACKGROUND ART

There has conventionally been provided a discharge lighting device capable of performing dimming control of a hot cathode type discharge lamp such as a fluorescent lamp. In the case of dimming, as a tube current is decreased (dimming level is increased), a filament temperature is decreased, and as the tube current is further decreased, discharge cannot be maintained, which in turn causes moving striations and flickering.

A conventional device addressing such a problem is described in, for example, Patent document 1. As illustrated in FIG. 13, the conventional device is configured to include four power supplies including an inverter power supply 1 for lighting, a DC-DC power supply 3 for lighting, a DC-DC power supply 4 for preheating, and an inverter power supply 2 for preheating filter. Dimming is performed by varying an output voltage of the DC-DC power supply 3 for lighting. Control of a filament current is performed by connecting the output voltage of the DC-DC power supply 3 for lighting to a feedback circuit 5 for the DC-DC power supply 4 for preheating, and varying an output voltage of the inverter power supply for preheating 2 in proportional to a level of the dimming.

Patent document 1: Japanese Unexamined Patent Publication No. 1995-211478

Patent document 2: Japanese Unexamined Patent Publication No. 2001-357994

DISCLOSURE OF THE INVENTION

Problem To Be Solved By the Invention

However, the above conventional example separately requires a power supply for controlling a tube current of a discharge lamp and that for controlling a filament current, and therefore has a problem that a circuit becomes complicated, and the number of parts is increased, resulting in an increase in cost.

In order to solve the above-described problem, the present invention is configured as one-converter power supply configuration, and has an object to provide a hot cathode type discharge lamp lighting device capable of ensuring stable discharge operation of a discharge lamp and simultaneously performing nonstep dimming control by increasing a filament current in response to a decrease in a tube current upon dimming.

Means Adapted To Solve Problems

1. In order to accomplish the above-described object, a first aspect of the present invention has: an oscillation control circuit for determining a frequency with time constant of R and C; a L-C series resonant circuit connected to a half-bridge or a full bridge circuit operating at said frequency; and a circuit in which one ends of hot cathode filaments at both ends of a hot cathode type discharge tube are respectively connected to both ends of a resonant capacitor, and a capacitor is further connected to other ends of the filaments at the both ends of the hot cathode type discharge tube to perform lighting; whereby (nonstep dimming) of a tube current is achieved by changing the oscillation frequency with a DC dimming control voltage by use of a variable capacitance diode as a capacitor for determining the frequency of the oscillation control circuit. Also, by simultaneously changing the tube current and a filament current of the hot cathode type discharge lamp in one-converter power supply configuration, and increasing the filament current as the tube current is decreased upon dimming, a reduction of a filament temperature can be prevented to maintain stable discharge. Simultaneously with this, the invention is characterized in that the capacitor (including a variable capacitance diode) for determining the oscillation frequency of the oscillation control circuit is configured by a plurality of parallel-connected capacitors; and by switching between these capacitors, a sufficient preheat current is ensured, and stable operation is performed.

According to the present invention, differently from multiple-converter power supply configuration in the conventional example, by employing the one-converter power supply configuration in which the L-C series resonant circuit is connected to the half-bridge or the full-bridge circuit, and increasing the filament current along with the nonstep dimming and the decrease in tube current upon the dimming, the reduction of the filament current can be prevented to maintain the stable discharge. Simultaneously with this, by arbitrarily setting the preheat current, the hot cathode type discharge lamp lighting device capable of achieving an increase in lifetime of a discharge lamp and stable lighting operation can be provided.

2. A second aspect of the present invention is characterized in that, in the first aspect of the present invention, the dimming (PWM dimming) is achieved by performing ON/OFF operation of capacitance of the capacitors at a frequency as low as 100 to 300 Hz, and controlling a time ratio of said ON/OFF.

According to the present invention, by using with the DC control dimming in the first aspect of the present invention, a hot cathode type discharge lamp lighting device capable of ensuring a wide dimming range and maintaining the stable discharge operation upon the dimming can be provided.

3. A third aspect of the present invention is characterized in that, in the second aspect of the present invention, a rise part of a power supply voltage fed from outside is detected, and by decreasing the capacitance of the capacitor for determining the oscillation frequency of the oscillation control circuit for a period of a few milliseconds in the rise part, the oscillation frequency is increased only during the period to suppress an overshoot voltage of a tube voltage of the hot cathode type discharge lamp.

According to the present invention, a hot cathode type discharge lamp lighting device capable of easily suppressing overshoot of rise waveforms of the tube voltage and the filament current in the rise part of the L-C series resonant circuit in the first aspect of the present invention by switching the capacitor with a transistor.

4. A fourth aspect of the present invention is characterized in that, in the first aspect of the present invention, a frequency smoothing circuit for gradually changing the frequency during a transition period from a preheating period to lighting operation of the discharge lamp is added to prevent lighting trouble and simultaneously reduce an overshoot voltage of a tube voltage. According to the present invention, by making gradual a rise waveform of a current flowed through the variable capacitance diode, a peak point of a series LC resonant circuit frequency-gain curve can be surely passed through to make a transition to a lighting frequency in the process of the transition of the frequency from a preheat frequency to the lighting frequency, and therefore a hot cathode type discharge lamp lighting device that prevents the lighting trouble and simultaneously reduces the overshoot voltage of the tube voltage can be provided.

5. A fifth aspect of the present invention is characterized in that, in the first aspect of the present invention, DC control and PWM control of the dimming can be performed.

According to the present invention, regarding the dimming in a range in which the tube current is large, the DC control dimming is performed, whereas in a range in which the tube current is small, the PWM dimming is performed, and thereby a discharge lamp lighting device characterized by being capable of achieving both ensuring of a variable range of the dimming, and stable discharge operation can be provided.

6. A sixth aspect of the present invention is characterized by, in the first aspect of the present invention, having a function of amplifying and determining detection signals for high-pressure side/low-pressure side open detection/protection, high-pressure side overvoltage protection, tube overcurrent protection, and high-pressure side leakage protection of the hot cathode type discharge tube to stop operation of a separately-excited PWM oscillation control integrated circuit. According to the present invention, a discharge lamp lighting device characterized by ensuring safety for leak current, tube voltage rise, and rube current rise due to filament disconnection in the hot cathode type discharge tube can be provided.

7. A seventh aspect of the present invention is characterized in that, in the first aspect of the present invention, the resonant capacitor of the series resonant output circuit is configured by a plurality of parallel-connected capacitors; by switching between these capacitors, the resonant frequency of the output circuit is changed; and by respectively optimizing a frequency-gain curve of the series LC resonant circuit for preheating and lighting, the preheat current and the tube current of the discharge lamp are optimized to surely perform the lighting.

According to the present invention, by switching between the resonant capacitors to respectively optimize the frequency-gain curve of the series LC resonant circuit for the preheating and the lighting, optimum gains respectively for the preheating and the lighting can be obtained, and the large preheat current and the tube current can be obtained. Also, by, after the switching between the resonant capacitors, changing the oscillation frequency of the oscillation circuit to perform the lighting operation, the hot cathode type discharge lamp is lit just before a peak frequency of the series L-C resonant circuit frequency-gain curve is reached, and simultaneously the peak frequency of the L-C resonant circuit frequency-gain curve is set to the same as a frequency upon the lighting, whereby a hot cathode type discharge lamp lighting device capable of preventing lighting failure due to peak skip to surely perform the lighting can be provided.

8. An eighth aspect of the present invention is characterized in that, in the first aspect of the present invention, the capacitor connected in series to the filaments of the discharge lamp is configured by a plurality of parallel-connected capacitors, and by switching between these capacitors, the filament current for the lighting is adjusted to an adequate value. According to the present invention, the filament current for the lighting operation can be set to any adequate value, and therefore a discharge lamp lighting device characterized by being capable of maintaining stable discharge of a hot cathode type discharge lamp upon dimming and achieving a long life time can be provided.

9. A ninth aspect of the present invention is characterized by, in the first to eighth aspects of the present invention, being capable of parallel connecting two or more series LC resonant circuits to a stage subsequent to the separately-excited oscillation control circuit and the half-bridge or full-bridge circuit. According to the present invention, by making a multiple parallel connection of the series L-C resonant circuits and discharge lamps, a multiple-discharge-lamp device can be easily achieved and provided.

Effect of the Invention

The present invention has the one-converter power supply configuration in which the L-C series resonant circuit is connected to the half-bridge or full-bridge circuit, differently from the conventional configuration including a plurality of converter power supplies, and has an effect capable of preventing the reduction in the filament temperature to maintain the stable discharge by increasing the filament current along with the nonstep dimming and the decrease in tube current upon the dimming.

Regarding the dimming, the DC control and the PWM control are combined, and thereby the present invention has an effect capable of obtaining the wide dimming range.

The present invention can arbitrarily set the preheat current, and therefore has an effect capable of achieving the increase in lifetime of the discharge lamp and the stable lighting operation.

By starting from a high oscillation frequency upon activation of the power supply, the present invention can suppress the overshoot of the tube voltage. Also, by adding the frequency smoothing circuit for gradually changing the frequency during the transition period from the preheating period to the lighting operation of the discharge lamp, the present invention has an effect of preventing the lighting trouble and simultaneously reducing the overshoot voltage of the tube voltage.

By detecting the leak current, tube voltage rise, and tube current rise due to the filament disconnection in the hot cathode type discharge tube to stop oscillation of a separately-excited PWM control IC, the present invention has an effect of enhancing safety.

By switching between the resonant capacitors to respectively optimize the series L-C resonant circuit frequency-gain curve for the preheating and the lighting, the present invention can respectively obtain the adequate gains for the preheating and the lighting, and the large preheat current and the tube current. Also, the present invention can set the peak frequency of the series L-C resonant circuit and the frequency upon the lighting close to each other, and therefore has an effect capable of surely performing the lighting operation of the hot cathode type discharge lamp just before the peak frequency of the series L-C resonant circuit frequency-gain curve is reached by changing the oscillation frequency of the oscillation circuit to perform the lighting operation after the switching between the resonant capacitors.

By configuring the capacitor connected in series to the filaments of the hot cathode type discharge lamp by the plurality of parallel-connected capacitors, and ON-OFF switching between these capacitors to adjust the filament current upon the lighting to the adequate value, the present invention has an effect capable of maintaining the stable discharge of the discharge lamp upon the dimming.

By making a multiple parallel connection of the series L-C resonant circuits to the stage subsequent to the separately-excited oscillation control circuit and the half-bridge or full-bridge circuit, the present invention has an effect capable of easily achieving and providing the multiple-discharge-lamp device.

BEST MODE FOR CARRYING OUT THE INVENTION

Figure 1:
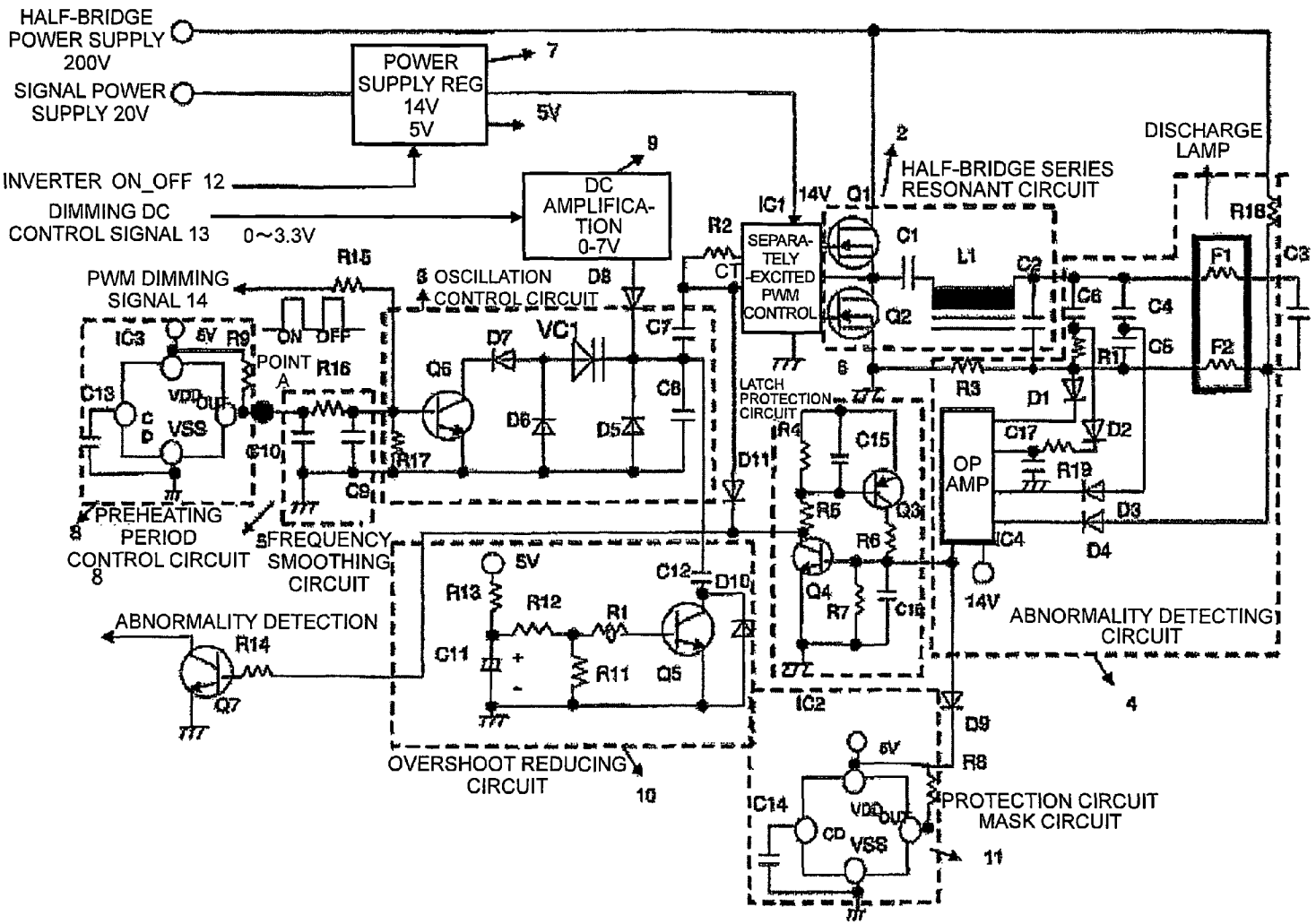
FIG. 1 is a circuit configuration diagram illustrating a first embodiment of a discharge lamp lighting device in the present invention.

A first embodiment of the present invention is described below on the basis of FIGS. 1 and 5 to 11. FIG. 1 is a diagram illustrating a circuit configuration of the first embodiment. A separately-excited PWM control integrated circuit IC1 is connected with an oscillation control circuit 3, a half-bridge series resonant circuit 2, and a latch protection circuit 6. The oscillation control circuit 3 includes a capacitor C8 for determining an oscillation frequency, and a variable capacitance diode VC1 for dimming, and an anode of the variable capacitance diode VC1 is connected with a switching transistor Q6 for ON-OFF switching. Also, one end of the capacitor C8 is connected with an overshoot reducing circuit 10 (soft start circuit for the case of inverter activation). Further, a base of the transistor Q6 is connected with a frequency smoothing circuit 5 for making a gradual transition of a frequency upon transition from a preheating period to lighting.

The half-bridge series resonant circuit 2 is configured by connecting a DC cut capacitor C1, a resonant coil L1, and a resonant capacitor C2 in series. An output of the half-bridge series resonant circuit 2 is connected to a high-pressure side filament F1 of a discharge lamp 1. Also, a low-pressure side filament F2 of the discharge lamp 1 is connected to ground through an overcurrent detecting resistor R3. The other terminals of the filaments F1 and F2 of the discharge lamp 1 are connected to a capacitor C3 for determining a filament current. Both ends of the resonant capacitor C2 are respectively connected with overvoltage detecting capacitors C4 and C5, and a midpoint between the capacitors C4 and C5 is inputted, through a diode D3, to an OP amplifier IC4 for amplifying a protection circuit detection signal. Also, a high frequency noise component generated when the filament F1 or F2 is disconnected to cause a leak current is differentiated by a capacitor C6 and a resistor R1, then integrated by a diode D2, a resistor R19, and a capacitor C17, and converted into a DC voltage, which is inputted as a detection signal to the OP amplifier IC4 for amplifying a protection circuit detection signal. Between a low-pressure side of the resonant capacitor C2 and ground, the overcurrent detecting resistor R3 is connected, and a voltage generated between both ends of the overcurrent detecting resistor R3 is inputted to the OP amplifier IC4 for amplifying a protection circuit detection signal through a diode D1 as an overcurrent detection signal. Also, between an intersection of the filament F2 and the capacitor C3, and the half-bridge power supply, a resistor R18 for detecting disconnection of the filament F2 is connected, and the above intersection with the filament F2 is inputted, through a diode D4, to the OP amplifier IC4 for amplifying a protection circuit detection signal. An output of the OP amplifier IC4 for amplifying a protection circuit detection signal is inputted to the latch protection circuit 6 and an IC2 including a protection circuit mask circuit 11.

Figure 7:
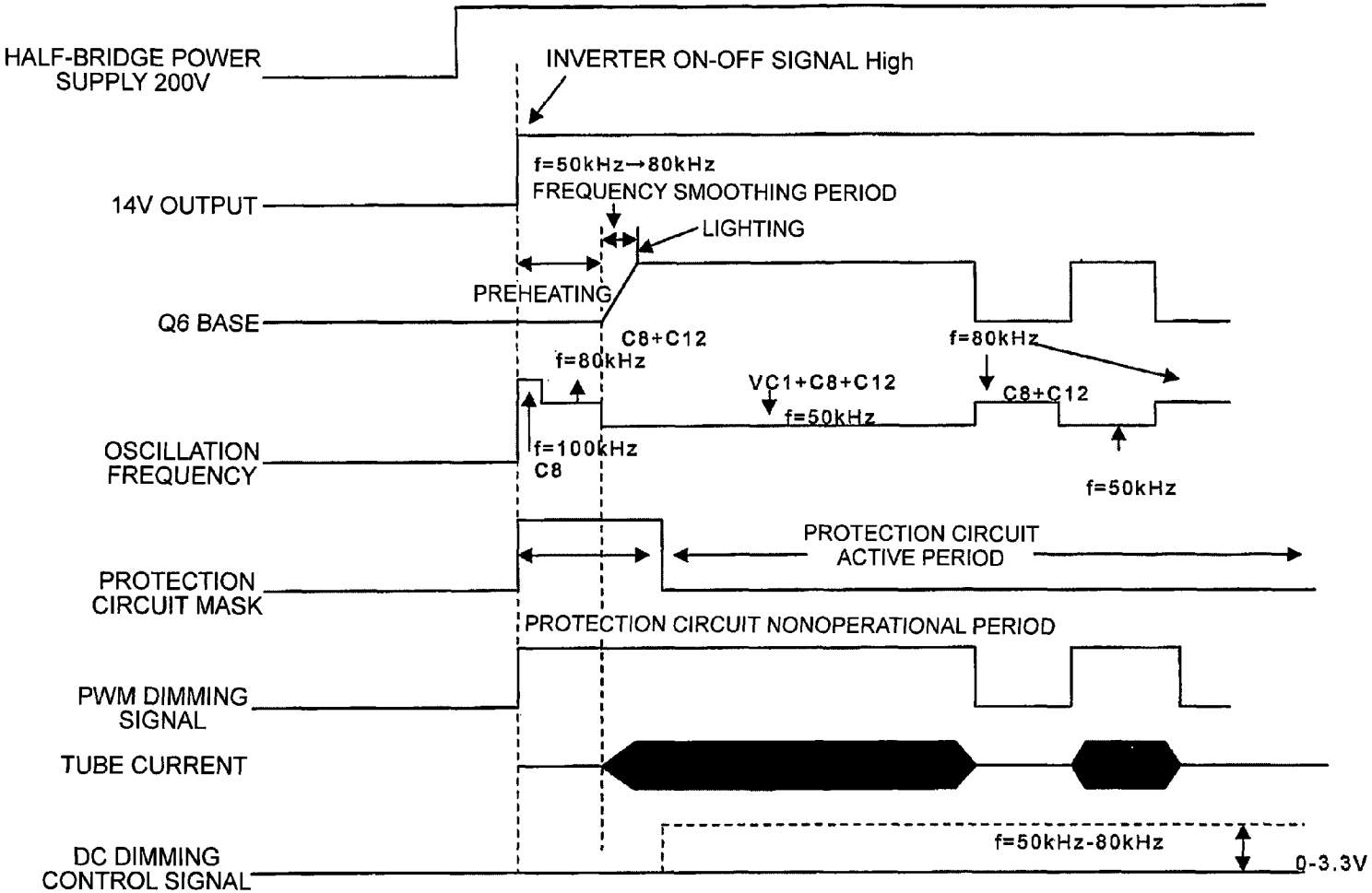
FIG. 7 is an explanatory diagram of a power supply sequence in the first embodiment of the present invention.
Figure 10:
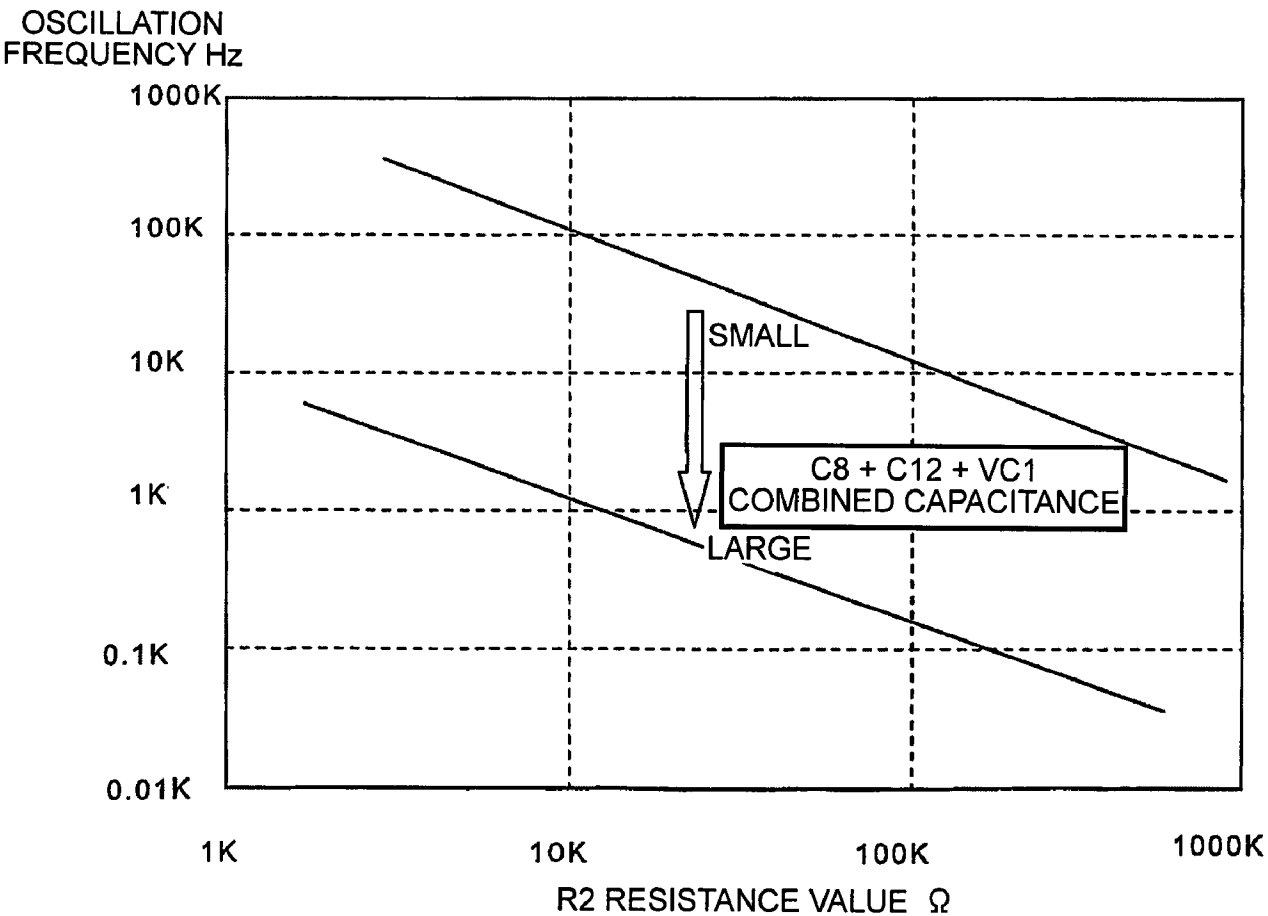
FIG. 10 is an explanatory diagram of IC1 frequency VS R2 resistance value in the first embodiment of the present invention.

FIG. 7 illustrates an example of a power supply sequence of the present invention. When an inverter ON-OFF signal 12 in FIG. 1 is switched to High, 14 V and 5 V are outputted to output terminals of a power supply REG 7 in FIG. 1. The separately-excited PWM control integrated circuit IC1 is activated, and a voltage is outputted to the half-bridge series resonant circuit 2. The output voltage at the time is determined by an oscillation frequency of the separately-excited PWM control integrated circuit IC1 and a series LC resonant circuit frequency-gain curve illustrated in FIG. 5. Also, the oscillation frequency is, as illustrated in FIG. 10, determined by a resistance R2, and a combined capacitance of the capacitors C8 and C12 and the variable capacitance diode VC1. Upon inverter activation, it oscillates at a frequency determined by the resistor R2 and the capacitor C8, for example, approximately 100 kHz (Point S in FIG. 5). Then, a transistor Q5 is turned ON, and it oscillates at a frequency determined by the resistance R2 and a combined capacitance of the capacitors C8 and C12, for example, approximately 80 kHz (Point (1) in FIG. 5). This period corresponds to the preheating period, during which current is flowed to the filaments F1 and F2 to heat the filaments. The filament current is unambiguously determined by $2\pi f \cdot C3 \cdot V$. By activation at a high frequency upon the inverter activation, the output voltage of the half-bridge series resonant circuit 2 is suppressed to achieve the soft start. Also, the preheating period is unambiguously determined by a capacitor C13 for determining an output delay time of a reset integrated circuit IC13 of a preheating time control circuit 12.

Figure 8:
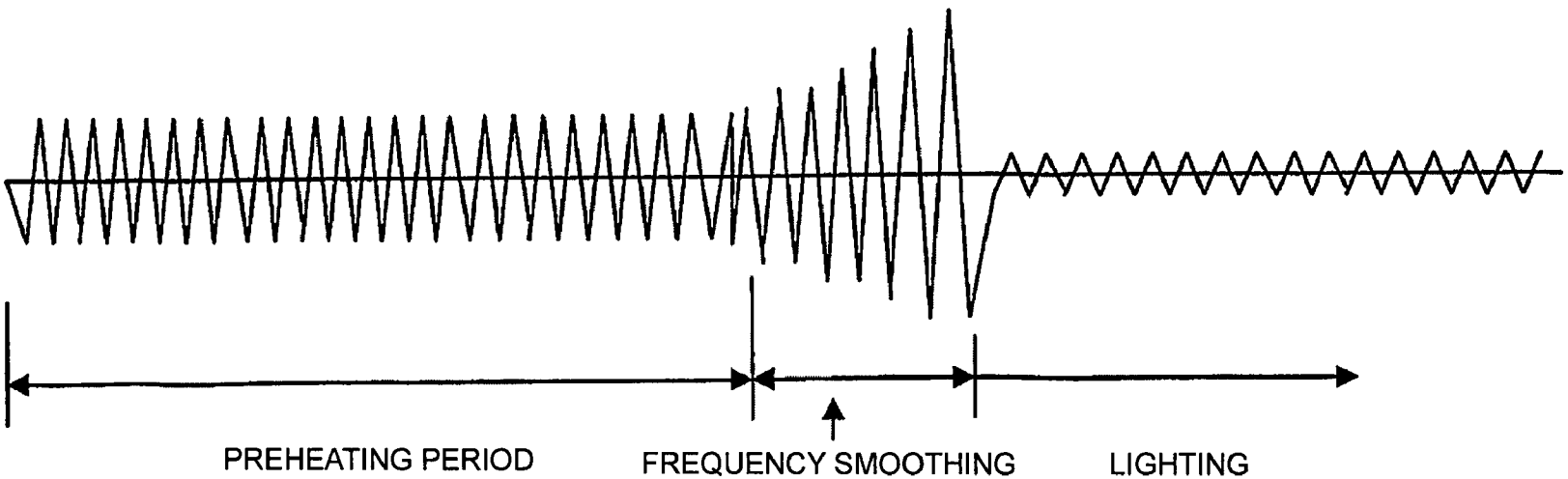
FIG. 8 is an explanatory diagram of frequency smoothing in the first embodiment of the present invention.
Figure 9:
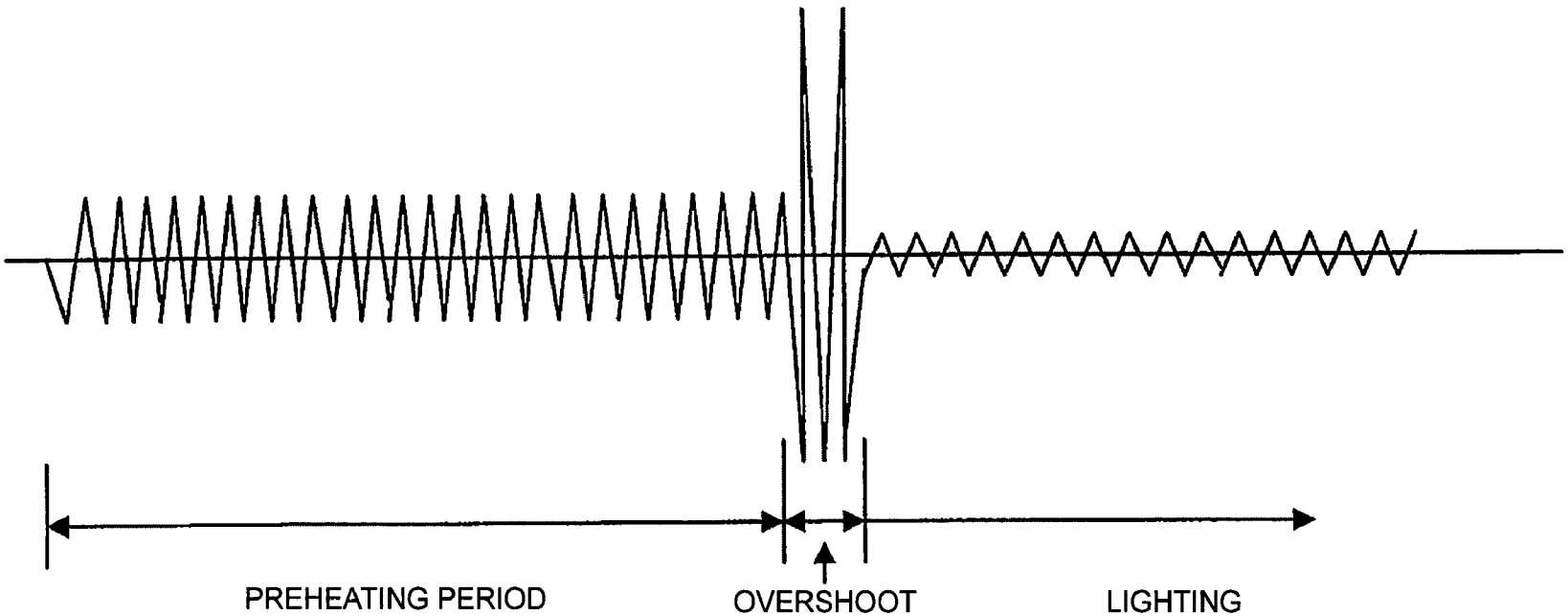
FIG. 9 is an explanatory diagram of a tube voltage waveform upon lighting in a conventional example.

After termination of the preheating period, an output voltage at Point A of the reset integrated circuit IC13 of the preheating period control circuit 12 in FIG. 1 becomes 5 V. This voltage is applied to the base of the transistor Q6 through the frequency smoothing circuit 5 to thereby make the transistor Q6 conductive. Based on this, the variable capacitance diode VC1 is connected to ground, and the oscillation frequency of the separately-excited PWM control integrated circuit IC1 is determined by the resistance R2, and the combined capacitance of the capacitors C8 and C12 and variable capacitance diode VC1. At this time, the oscillation frequency is assumed to be, for example, 50 kHz. A gain is gradually increased from Point (1) of the series LC resonant circuit frequency-gain curve in FIG. 5 along the curve, and when it reaches a discharge start voltage of the hot cathode type discharge lamp at Point (2), the tube current starts to flow. As the tube current flows, an impedance of the tube is reduced, and therefore, finally, at Point (3), the stable discharge is generated. The voltage at the output point A of the IC 13 is integrated by capacitors C10 and C9 and resistor R16 of the frequency smoothing circuit 5, and therefore the rise thereof is made gradual. Based on this, a base current of the transistor Q6 also gradually rises. By making gradual a waveform of current flowing through the variable capacitance diode VC1, the oscillation frequency exhibits a gradual transition from 80 kHz to 50 kHz, and the frequency is smoothed. This effect is illustrated in FIGS. 8 and 9. FIGS. 8 and 9 respectively illustrate the waveforms for the cases of the presence and absence of the frequency smoothing circuit. By making the gradual transition of the frequency from 80 kHz to 50 kHz to smooth the frequency, the voltage gain can surely pass through the discharge start voltage (2) of the hot cathode type discharge lamp in the series LC resonant circuit frequency-gain curve of FIG. 5 to moves to Point (3), and therefore secure lighting operation can be performed. There is also an effect of reducing overshoot of the tube voltage and the tube current.

Figure 11:
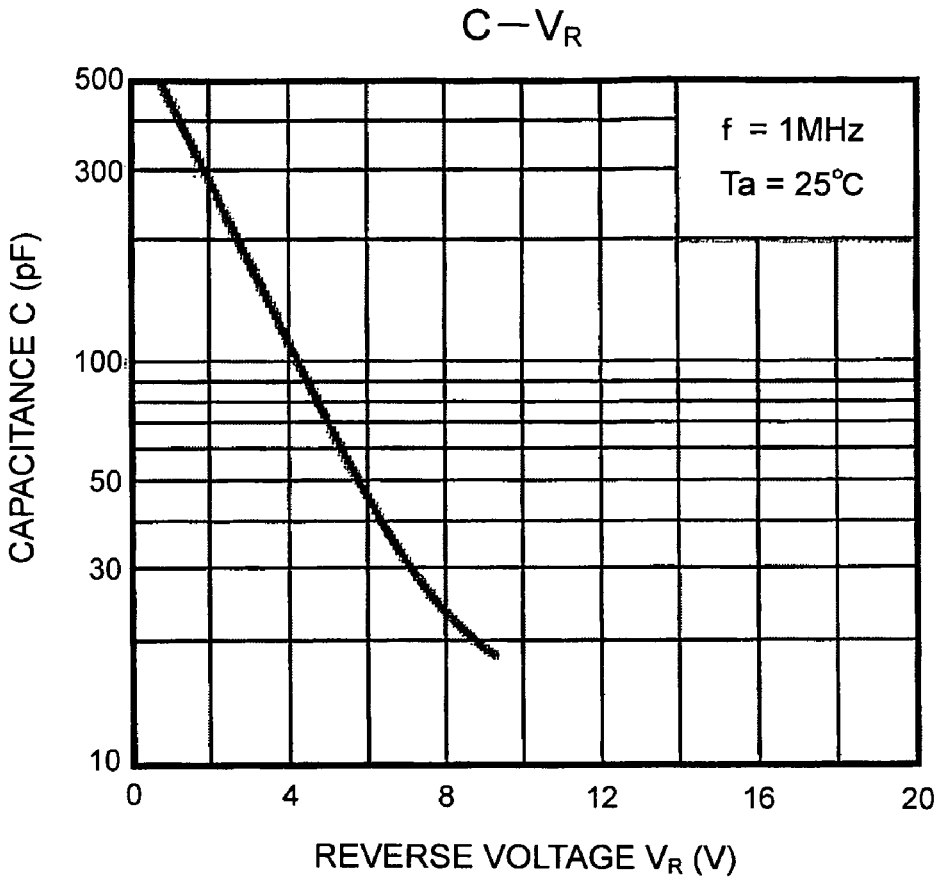
FIG. 11 is an explanatory diagram of capacitance of a variable capacitance diode VC1 VS reverse voltage in the first embodiment of the present invention.

Next, dimming operation is described. As a dimming DC control signal 13 in FIG. 1, for example, 0 to 3.3 V is inputted to a DC amplifier circuit 9, and an output of the DC amplifier circuit 9 is applied to a cathode side of the variable capacitance diode VC1 through a diode D8. FIG. 11 is a graph illustrating a cathode voltage and variation in capacitance of the variable capacitance diode VC1. The variable capacitance diode VC1 is characterized in that as an applied DC voltage is increased, a capacitance value decreases. That is, by changing the DC voltage applied to the variable capacitance diode VC1, the oscillation frequency of the separately-excited PWM control integrated circuit IC1 can be changed. Accordingly, as a dimming DC control voltage is increased, the frequency in the series LC resonant circuit frequency-gain curve of FIG. 5 changes from f=50 kHz at Point (3) corresponding to lighting to f=80 kHz at Point (1) corresponding to preheating along a dashed arrow line. At this time, the filament current is determined by $2\pi f \cdot C3 \cdot V$, and therefore increases as the frequency is increased. On the other hand, the tube current decreases due to a reduction in L-C series resonant circuit gain, inversely with the increase in filament current.

Figure 6:
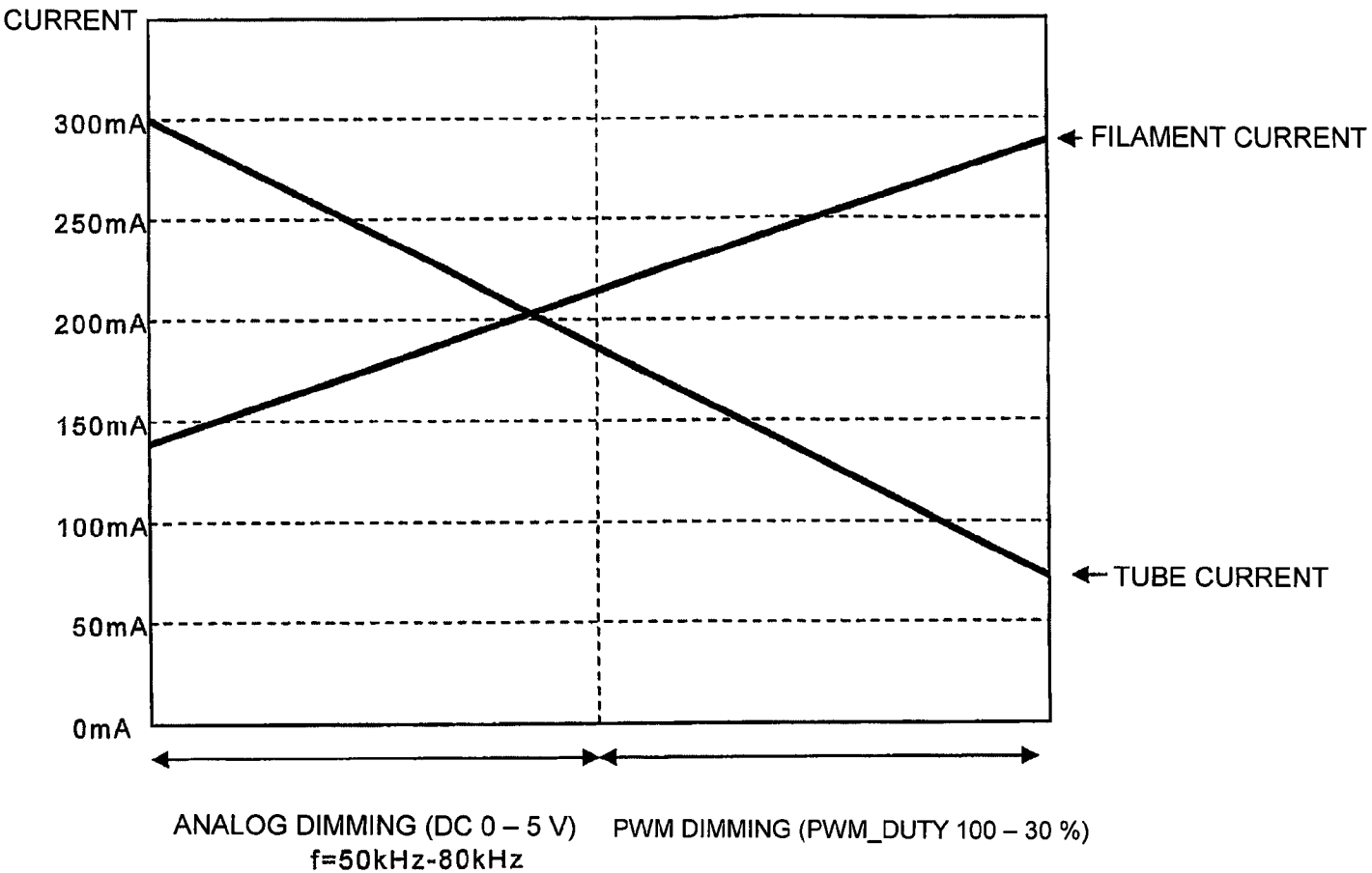
FIG. 6 is an explanatory diagram of dimming characteristics in the first embodiment of the present invention.

If the tube current is decreased too much by increasing the dimming DC control voltage, weak discharge occurs in which regular discharge cannot be maintained, and therefore flickering and moving striations may appear, resulting in extinction. As a measure for this, as illustrated in FIG. 6, in the case where the tube current takes an arbitrary setting value or less, the tube current is ON-OFF switched with a PWM dimming signal having 100 to 300 Hz to expand a dimming range and maintain the stable discharge. This PWM dimming can be controlled by the transistor Q6 for ON-OFF switching the variable capacitance diode VC1 in FIG. 1. When the PWM dimming signal is turned OFF, the variable capacitance diode VC1 is blocked, and thereby the oscillation frequency of the separately-excited PWM control integrated circuit IC1 becomes f=80 kHz (Point (1) in FIG. 5) to cut off the tube current. A relationship between the PWM dimming signal and the tube current is illustrated in FIG. 7.

Next, operation of an abnormality detecting circuit 4 in FIG. 1 is described. The capacitors C4 and C5 and diode D3 in FIG. 1 constitute an overvoltage protection circuit for the tube. A high-pressure side tube voltage is inputted to the voltage amplifying OP amplifier IC4 through the diode D3 as a voltage subjected to voltage dividing by the capacitors C4 and C5. If the voltage becomes some threshold or more, an output voltage of the OP amplifier 14 becomes 14 V, and thereby a transistor Q4 of the latch protection circuit 6 is made conductive. At this time, by grounding a CT terminal of the separately-excited PWM control integrated circuit IC1, oscillation stop operation is performed. Also, if the transistor Q4 is made conductive, a thyristor circuit in which a transistor Q3 is conductive is formed, and therefore even if the output voltage of the OP amplifier IC4 becomes 0 V, an oscillation stop state of the separately-excited PWM control integrated circuit IC1 is maintained.

Next, disconnection protection operation for the filaments F1 and F2 is described. The capacitor C3 side of the low-pressure side filament F2 of the discharge lamp 1 is pulled up to a power supply voltage of 200 V by the resistor R18. The intersection voltage between the filament F2 and the capacitor C3 becomes [200 V×(resistance value of the resistor R3+resistance value of the filament F2)/resistance value of the resistor R18]. The resistance value of the resistor R18 is preset to a value sufficiently larger than (resistance value of the resistor R3+resistance value of the filament F2). A bias voltage to the filament F2 is inputted to the OP amplifier IC4 through the diode D4. If the filament F2 is made highly resistive or disconnected by some problem, the input voltage of the OP amplifier IC4 is increased, and therefore as described above, the oscillation stop state of the separately-excited PWM control integrated circuit IC1 is maintained. On the other hand, if the high-pressure side filament F1 is made highly resistive or disconnected, the tube current is increased and the above-describe overvoltage protection circuit is operated. As described above, the present invention is characterized by using both of the overvoltage protection circuit of a capacitor voltage dividing system and the bias voltage detecting circuit for the low-pressure side filament F2, and based on this, can easily detect disconnection of the high- and low-pressure side filaments F1 and F2 with accuracy.

Next, operation of the overcurrent protection circuit is described. The resistor R3 is an overcurrent detecting resistor, through which the tube current+filament current flow. The voltage generated between the both ends of the resistor R3 is inputted to the OP amplifier IC4 through the diode D3. If the tube current or the filament current of the discharge lamp 1 is increased by some abnormality, and thereby the voltage between the both ends of R3 becomes some threshold or more, the output of the OP amplifier IC4 becomes 14 V to operate the above-described latch protection circuit 6, and therefore the oscillation stop state of the separately-excited PWM control integrated circuit IC1 is maintained.

Next, operation of the leak current protection circuit is described. Differential detection of a high frequency leak current noise component, which is caused by leakage due to disconnection of the filament F1 or F2 of the discharge lamp 1, high-pressure side pattern foil disconnection, or the like, is performed with the capacitor C6 and the resistor R1; the detected value is integrated with the resistor R19 and the capacitor C17; and the integrated value is defined as a detection voltage. If the detection voltage becomes equal to or more than some threshold, the output of the OP amplifier IC4 becomes 14 V, so that the above-described latch protection circuit 6 is operated, and therefore the oscillation stop state of the separately-excited PWM control integrated circuit IC1 is maintained.

Figure 2:
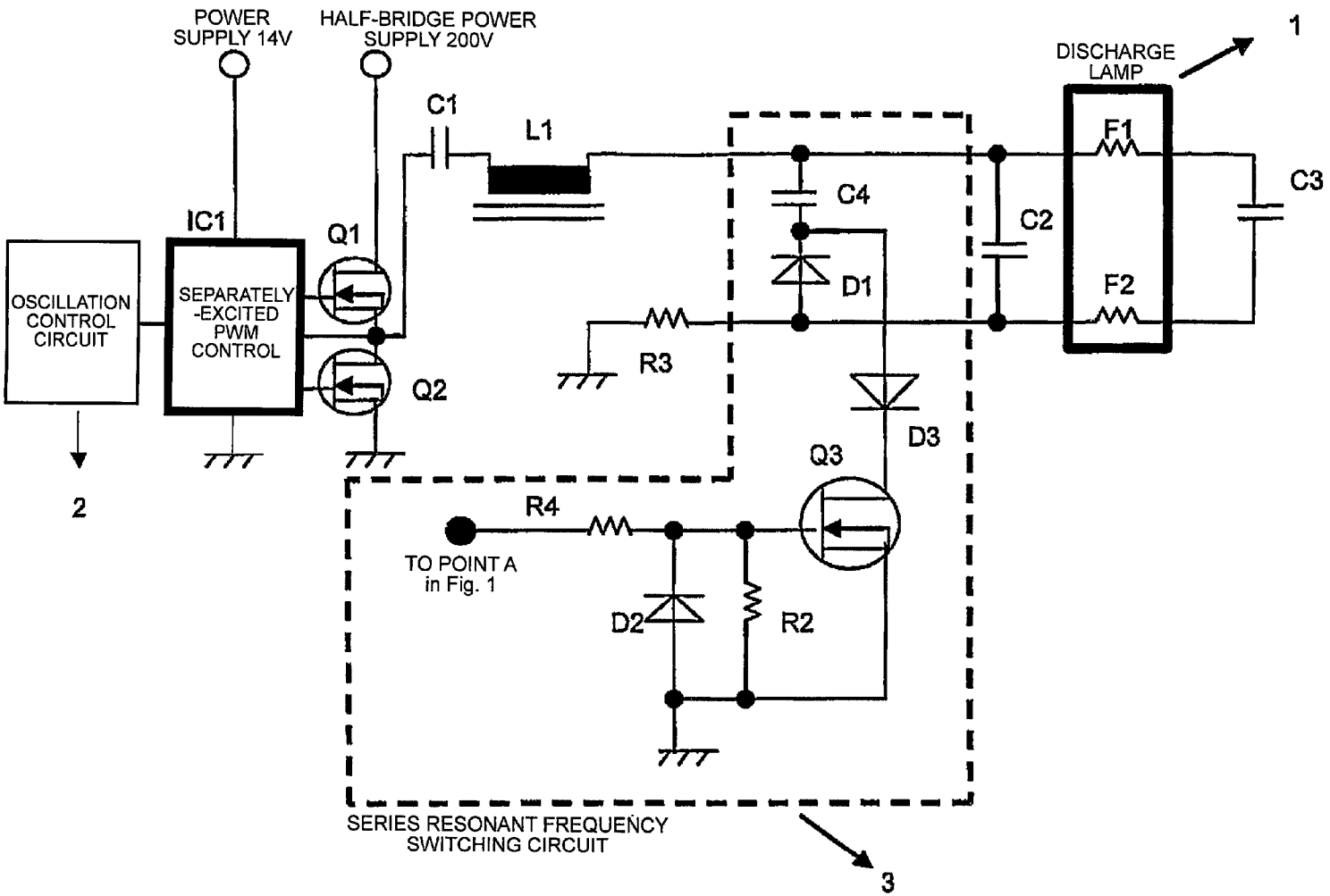
FIG. 2 is a circuit configuration diagram illustrating a second embodiment of the discharge lamp lighting device in the present invention.
Figure 12:
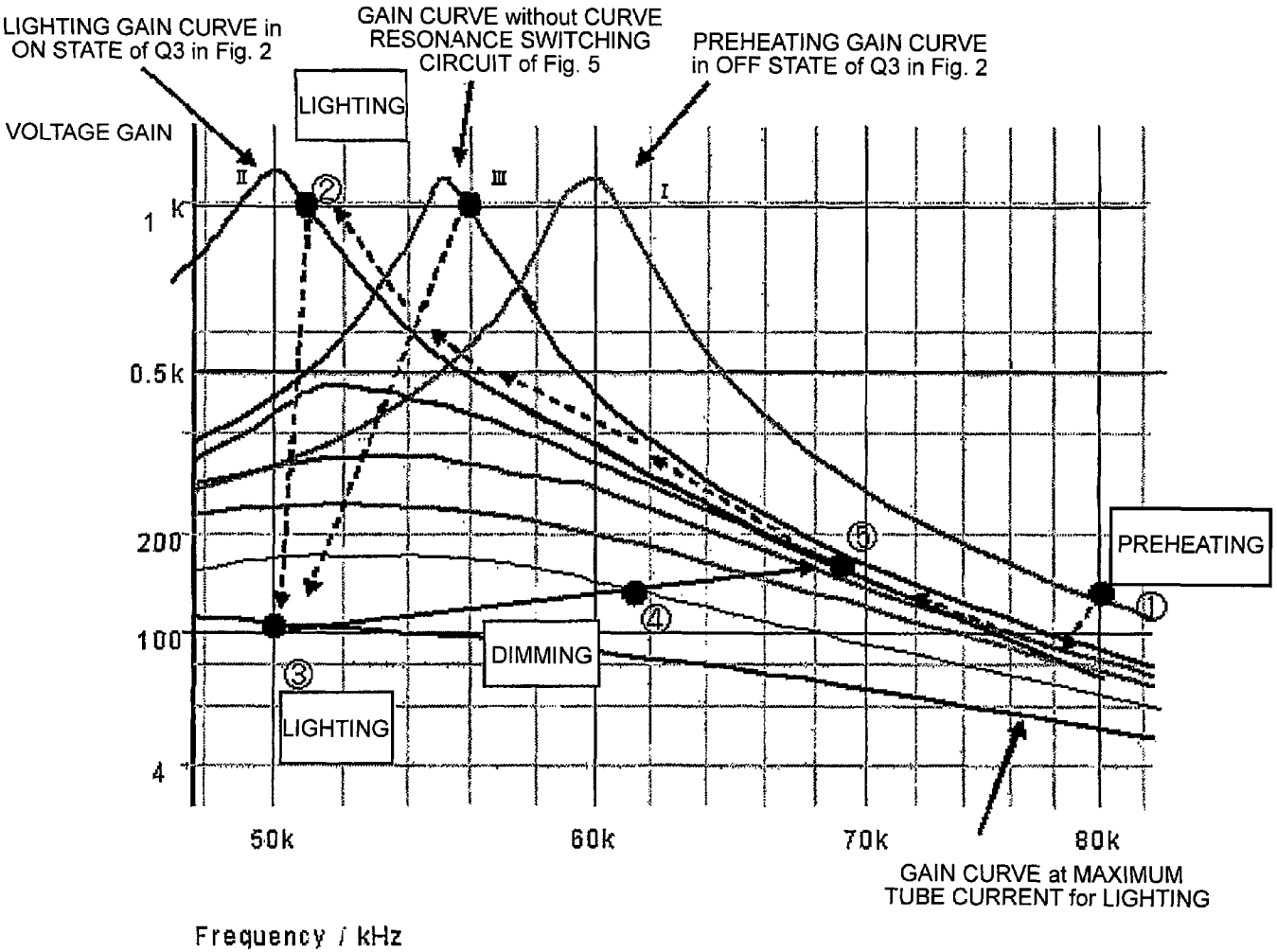
FIG. 12 is an explanatory diagram of a series LC resonant circuit frequency-gain curve in the second embodiment of the present invention.
Figure 13:
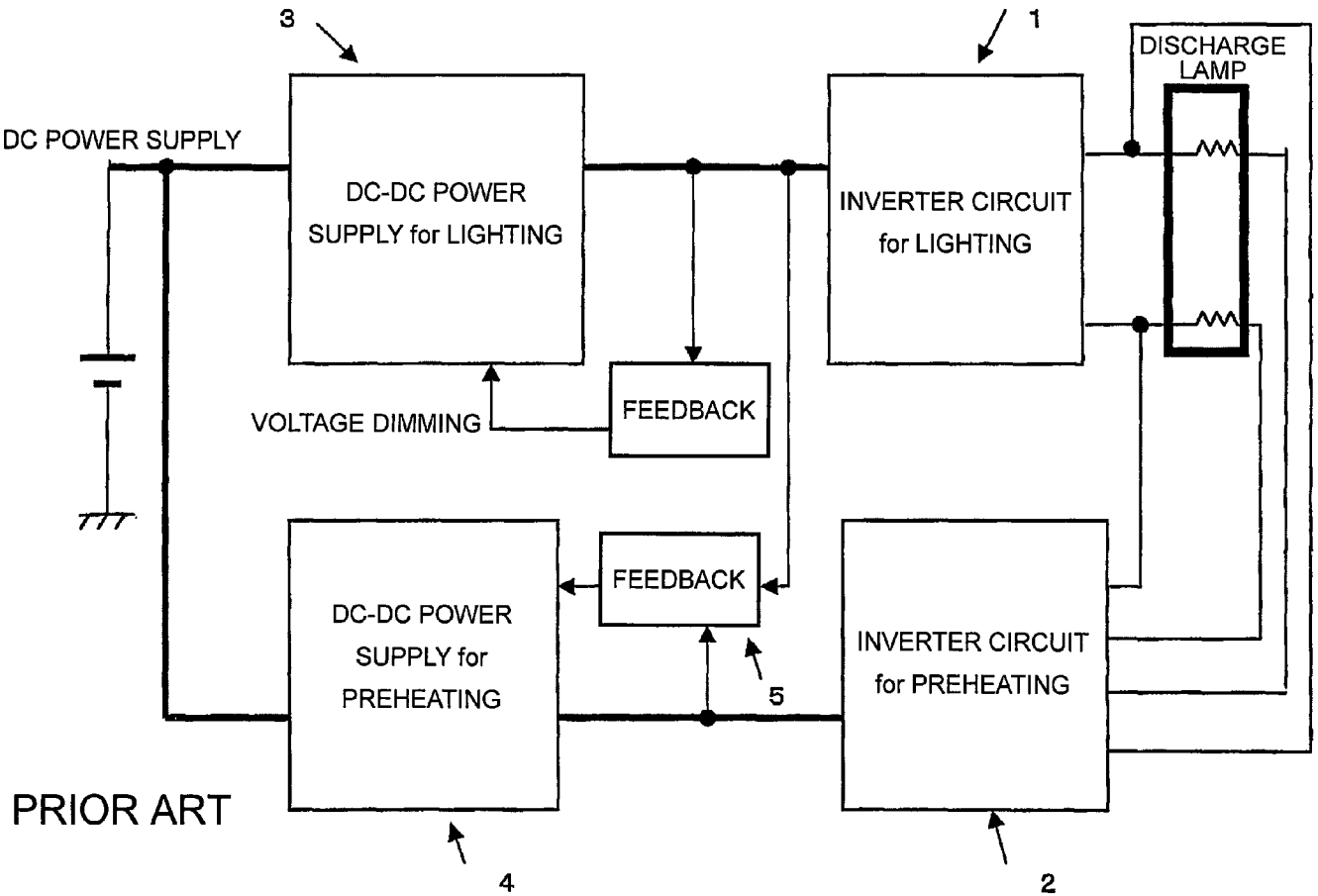
FIG. 13 is a configuration diagram illustrating the conventional example, i.e., Japanese Unexamined Patent Publication No. 1995-211478 [Patent document 1].

In the following, a second embodiment of the present invention is described on the basis of FIGS. 2 and 12. FIG. 2 is a diagram illustrating a circuit configuration of the second embodiment. By adding to the first embodiment of FIG. 1 a series resonant frequency switching circuit 3 including a resonant capacitor C4 for switching, a commutating diode D1, an MOSFET Q3 for ON-OFF switching the capacitor C4, the resistors R2 and R4, the diode D2, and a current blocking diode D3, and respectively providing optimum L-C series resonant circuit gain curves for preheating operation and lighting operation, optimization of a preheat current and a tube current, and the lighting operation can be surely performed. As an example, as illustrated in FIG. 12, a peak frequency of the L-C series resonant circuit-gain curve is set to f=60 kHz (I) for preheating, and to f=approximately 50 kHz (II) for lighting. A peak frequency in the first embodiment is assumed to be f=approximately 55 kHz (III). During the preheating, a gate voltage of the MOSFET Q3 is 0 V, and the MOSFET is in an OFF state, so that a resonant capacitor includes only C2, and therefore the L-C series resonant circuit-gain curve indicated by (I) is applied. At the instant of change from the preheating to lighting, the gate voltage of the MOSFET Q3 becomes 14 V, and the MOSFET Q3 is made conductive, so that the resonant capacitor includes C2+C4, and therefore the L-C series resonant circuit-gain curve indicated by (II) is applied. An oscillation frequency of a separately-excited PWM control integrated circuit IC1 is switched through the frequency smoothing circuit 5 in FIG. 1, and therefore switched later than the switching of the L-C series resonant circuit-gain curve. It turns out that, during the preheating, a large gain can be achieved at Point (1) f=80 kHz in FIG. 12, as compared with the L-C series resonant circuit-gain curve (III) in the first embodiment. If a capacitance of a capacitor C3 for determining a filament current is the same, a larger filament current can be flowed. Also, if the filament current is the same, the capacitance of the capacitor C3 can be made smaller, and therefore the filament current upon the lighting can be made smaller. After termination of the preheating, the L-C series resonant circuit-gain curve is switched from (I) to (II); a frequency is decreased along the curve (II) with being subjected to frequency smoothing; after lighting at Point (2) corresponding to a lighting start voltage, which is just before a peak of the L-C series resonant circuit-gain curve, a tube impedance is decreased; and at Point (3) (peak point), stable discharge is generated. DC dimming control is performed by changing a frequency along a path of Point (3)→Point (4)→Point (5).

Figure 3:
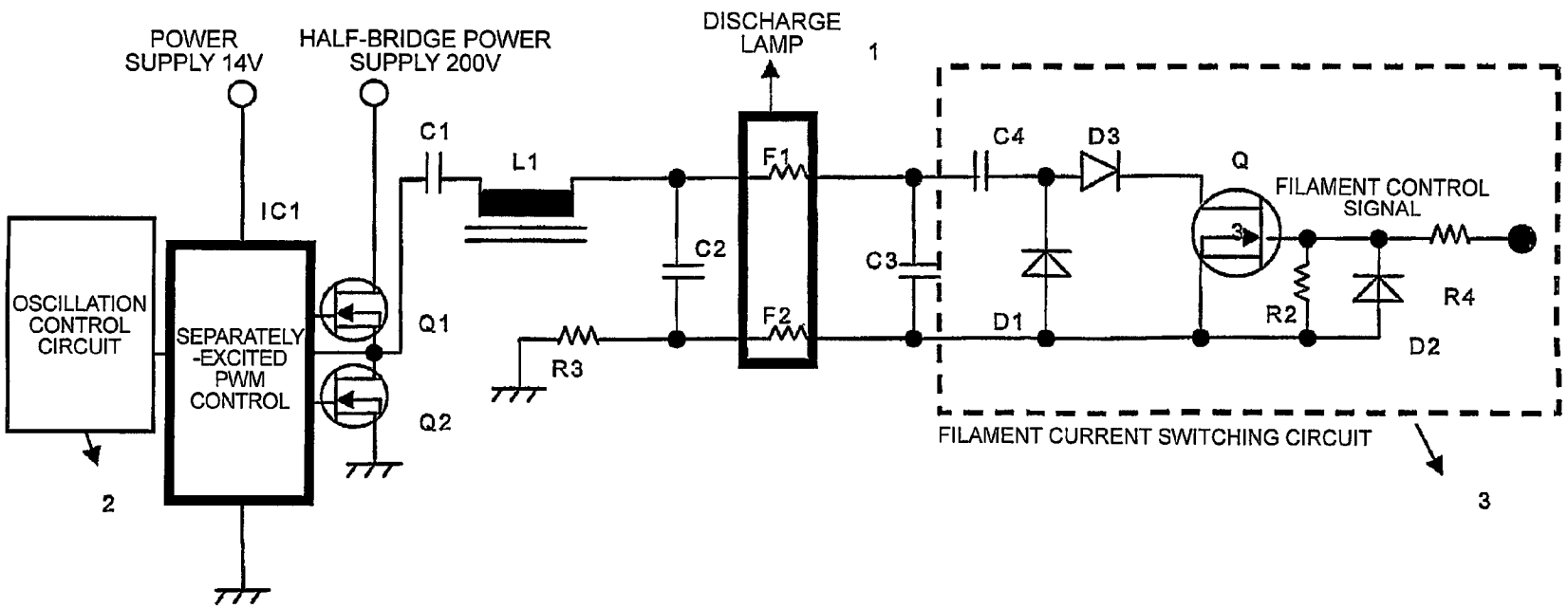
FIG. 3 is a circuit configuration diagram illustrating a third embodiment of the discharge lamp lighting device in the present invention.

In the following, a third embodiment of the present invention is described on the basis of FIG. 3. FIG. 3 is a diagram illustrating a circuit configuration of the third embodiment. The capacitor C4 for switching a filament current, the commutating diode D1, the MOSFET Q3 for ON-OFF switching the capacitor C4, the resistors R2 and R4, and the diode D3 are provided. A gate of the MOSFET Q3 is applied with a filament control signal. As an example of implementation, assuming 14 V for preheating, and 0 V for lighting, the MOSFET Q3 is turned ON for the preheating, and turned OFF for the lighting. This enables a filament current during the lighting to be reduced. The filament current during the preheating can be $2\pi f\cdot(C3+C4)\cdot V$, and the filament current during the lighting can be $2\pi f\cdot C3\cdot V$, respectively. On the other hand, assuming 0 V for the preheating, and 14 V for the lighting, the filament current becomes $2\pi f\cdot(C3+C4)\cdot V$ during the lighting, and therefore can be increased larger than that during the preheating. The filament current for the lighting operation can be set to any adequate value, and therefore stable discharge of a discharge lamp upon dimming can be maintained, and a longer lifetime can be achieved.

Figure 4:
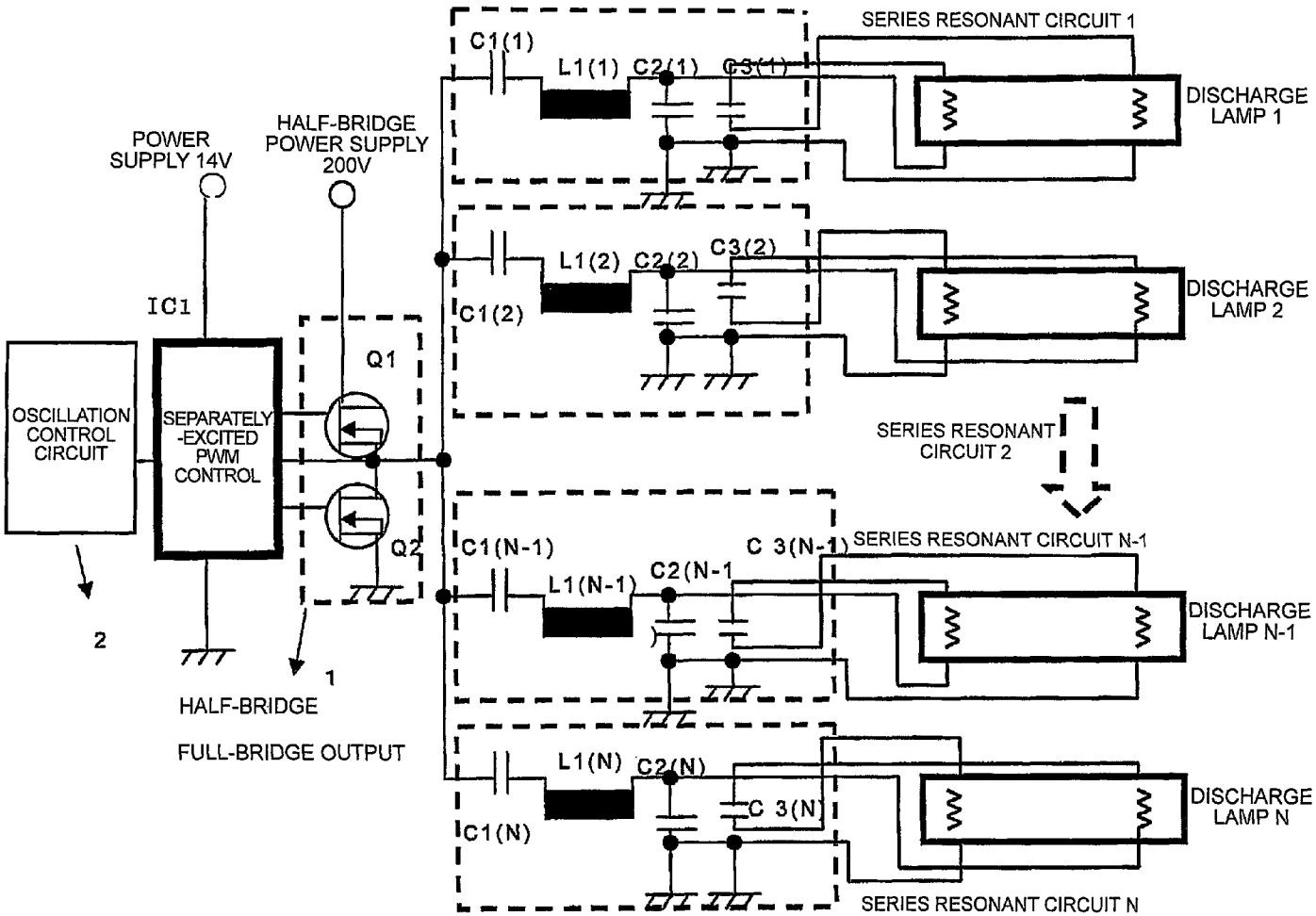
FIG. 4 is a circuit configuration diagram illustrating a fourth embodiment of the discharge lamp lighting device in the present invention.
Figure 5:
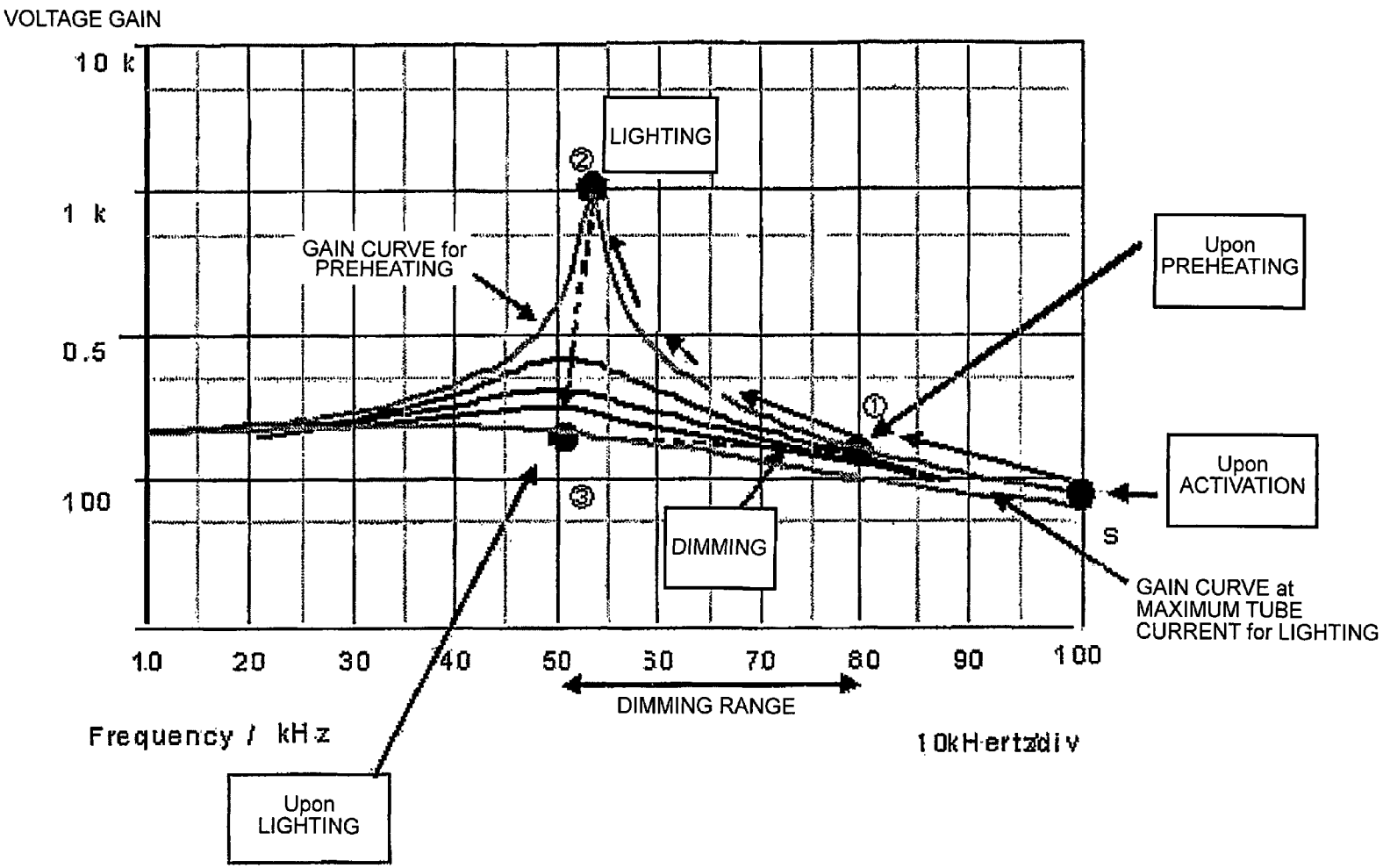
FIG. 5 is an explanatory diagram of a series LC resonant circuit frequency-gain curve in the first embodiment of the present invention.

In the following, a fourth embodiment of the present invention is described on the basis of FIG. 4. FIG. 4 is a diagram illustrating a circuit configuration of the fourth embodiment. Series resonant circuits 1 to N, and discharge lamps 1 to N are connected in parallel to the half-bridge or full-bridge output 2 in the first embodiment, and thereby a connection for multiple discharge lamps can be easily achieved.

INDUSTRIAL APPLICABILITY

As described above, a discharge lamp lighting device according to the present invention can achieve stable driving and dimming of a low-cost high-efficiency discharge lamp at low cost, and is therefore useful for lighting devices of various home appliances, and a LCD backlight device.

What is claimed is:

1. A discharge lamp lighting device comprising:

an oscillation control circuit that uses a variable capacitance diode to determine an oscillation frequency based on a DC dimming control voltage;

an LC series resonant circuit that is connected to a half bridge circuit or a full bridge circuit;

a hot cathode type discharge lamp that has filaments respectively arranged at both ends; and a load capacitor that is connected to one ends of the two filaments and determines a filament current on a basis of said oscillation frequency, wherein:

said LC series resonant circuit has a resonant capacitor that is connected to other ends of the two filaments and determines a tube voltage of said discharge lamp on the basis of said oscillation frequency; and said oscillation control circuit switches ON/OFF current flowing into any of two or more oscillation capacitors including said variable capacitance diode to thereby change said oscillation frequency, and upon dimmed operation, by changing said DC dimming control voltage, changes said oscillation frequency to decrease a tube current of said discharge lamp and also increase said filament current.

2. The discharge lamp lighting device according to claim 1, wherein by switching ON/OFF said tube current of said discharge lamp at a frequency of 100 to 300 Hz, PWM dimming control of said discharge lamp is performed.

3. The discharge lamp lighting device according to claim 1, wherein said oscillation frequency upon rise of an externally supplied power supply voltage is increased.

4. The discharge lamp lighting device according to claim 1, comprising a frequency smoothing circuit that gradually change said oscillation frequency before and after lighting of said discharge lamp.

5. The discharge lamp lighting device according to any of claims 1 to 4, comprising:

an overvoltage protection circuit that, on a basis of said tube voltage of said discharge lamp, stops supply of power to the two filaments;

a bias voltage detection circuit that, on a basis of a resistance value of a lower voltage side filament of said discharge lamp, stops the supply of the power to the two filaments;

an overcurrent protection circuit that, on a basis of said tube current and said filament current, stops the supply of the power to the two filaments; and a leak current protection circuit that, on a basis of a high frequency noise component occurring upon disconnection of any of the two filaments, stops the supply of the power to the two filaments.

6. The discharge lamp lighting device according to any of claims 1 to 4, wherein said oscillation capacitor is configured to parallel connect two or more capacitors including a capacitor that can switch ON/OFF current flowing in.

7. The discharge lamp lighting device according to any of claims 1 to 4, wherein said load capacitor is configured to parallel connect two or more capacitors including a capacitor that can switch ON/OFF current flowing in.

8. The discharge lamp lighting device according to claim 1, comprising two or more LC series resonant circuits, wherein said LC series resonant circuits are respectively connected to different discharge lamps.

* * * * *